US006354203B2

(12) United States Patent
Bäcker et al.

(10) Patent No.: US 6,354,203 B2
(45) Date of Patent: Mar. 12, 2002

(54) BELT DRIVE FOR A MACHINE FOR PROCESSING FLAT PRINTING MATERIALS

(75) Inventors: Dieter Bäcker, Sandhausen; Ralf Weiser, Ladenberg; Roland Hirth, Römerberg, all of (DE); Richard Mack, Kennesaw, GA (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/801,211

(22) Filed: Mar. 7, 2001

(30) Foreign Application Priority Data

Mar. 7, 2000 (DE) ..... 200 04 213

(51) Int. Cl.[7] ..... B41F 13/24

(52) U.S. Cl. ..... 101/232; 198/219; 198/813; 198/814; 198/816

(58) Field of Search ..... 101/232, 1; 198/814, 198/813; 209/219

(56) References Cited

U.S. PATENT DOCUMENTS 4,144,808 A * 3/1979 Iwasa et al. ..... 101/1
5,476,041 A * 12/1995 Czotscher ..... 101/232
5,584,249 A * 12/1996 Vande Berg ..... 104/250
5,615,775 A * 4/1997 Barbaret ..... 209/219
6,182,567 B1 * 2/2001 Gunschera ..... 101/232

* cited by examiner

*Primary Examiner*—John S. Hilten
*Assistant Examiner*—Marvin P. Crenshaw
(74) *Attorney, Agent, or Firm*—Herbert L. Lerner; Laurence A. Greenberg; Werner H. Stemer

(57) ABSTRACT

A belt drive for a machine for processing flat printing materials includes an endless belt revolving during operation, a roller about which the belt is partially looped, a frame with respect to which the roller is adjustable between a working position, wherein the roller keeps the belt tensioned, and a position moved away from the working position, wherein the belt is untensioned, and a spring device for biasing the roller into the working position thereof. Also included are a double crank by which the roller is articulated with the frame, and a stop which, due to a change in position of the double crank from a position corresponding to the working position of the roller into a position corresponding to the moved-away position of the roller, is carried out to a given extent beyond a dead-center position of the double crank, prevents a change in position beyond the given extent; and a machine for processing flat printing materials, which includes the belt drive.

5 Claims, 5 Drawing Sheets

BELT DRIVE FOR A MACHINE FOR PROCESSING FLAT PRINTING MATERIALS

BACKGROUND OF THE INVENTION

Field of the Invention

The invention relates to a belt drive for a machine for processing flat printing materials, having an endless belt revolving during operation, a roller about which the belt is partially looped, a frame with respect to which the roller is adjustable between a working position, wherein the roller keeps the belt in tension, and a position moved away from the working position, wherein the belt is not in tension, and a spring device for biasing the roller into the working position thereof, as well as for a machine for processing flat printing materials, in particular, a rotary printing machine, having a conveying station in the form of a feeder, for supplying sheets to a first processing station, and a conveying station in the form of a delivery, for feeding sheets accepted from a last processing station to a pile-forming or stacking station, the conveying stations being equipped with belt drives.

A belt drive of the foregoing general type has become known heretofore from, for example, the published German Patent Document DE 197 12 690 A1. A spring device which is disclosed in this document for biasing the roller into the working position thereof is constructed, in one exemplary embodiment, as a compression-spring device, wherein a compression spring acts between an abutment linked to a frame, and a lever connected to a tensioning shaft in the form of an eccentric shaft rotatably mounted in the frame, the lever being fixed against rotation relative to the rotatable eccentric shaft. Under the action of the compression spring, an eccentric section of the tensioning shaft is set against a carriage rotatably bearing the roller and being displaceable with respect to the frame. An end of the lever facing away from the tensioning shaft is connected by a hinge to a nonrotatable threaded pin which, through the intermediary of an adjusting nut cooperating therewith and supporting it on the abutment, is withdrawable into an opening formed in the abutment, thereby, in effect, shortening the compression spring. By a rotation of the tensioning shaft, which accompanies the shortening of the compression spring, the shaft assumes a rotational position wherein the roller is adjustably displaced from the working position thereof into the position moved away therefrom. In this moved-away position, the endless belt can be drawn onto the roller and drawn off the latter, respectively. To change the belt if it should become worn, a screwing operation is needed in order to remove the tension of the belt which is to be drawn off, and a further screwing operation is necessary in order to apply tension to a newly drawn-on belt.

SUMMARY OF THE INVENTION

It is accordingly an object of the invention to provide a belt drive of the type mentioned in the introduction hereto, for changing which, measures have been simplified, and require the least possible expenditure of time.

With the foregoing and other objects in view, there is provided, in accordance with one aspect of the invention, a belt drive for a machine for processing flat printing materials, comprising an endless belt revolving during operation, a roller about which the belt is partially looped, a frame with respect to which the roller is adjustable between a working position, wherein the roller keeps the belt tensioned, and a position moved away from the working position, wherein the belt is untensioned, a spring device for biasing the roller into the working position thereof, a double crank by which the roller is articulated with the frame, and a stop which, due to a change in position of the double crank from a position corresponding to the working position of the roller into a position corresponding to the moved-away position of the roller, is carried out to a given extent beyond a dead-center position of said double crank, preventing a change in position beyond said given extent.

In accordance with another feature of the invention, the double crank is formed by an eccentric shaft and a guide rod articulated eccentrically therewith.

In accordance with a further feature of the invention, the stop is formed on the eccentric shaft and, in the position of the double crank corresponding to the moved-away position of the roller, butts against the guide rod.

In accordance with another aspect of the invention, there is provided a machine for processing flat printing materials, comprising a conveying station in the form of a feeder for supplying sheets to a first processing station, and a conveying station in the form of a delivery for feeding sheets accepted from a last processing station to a sheet pile station, at least one of the conveying stations being equipped with a belt drive, including an endless belt revolving during operation, a roller about which the belt is partially looped, a frame with respect to which the roller is adjustable between a working position, wherein the roller keeps the belt tensioned, and a position moved away from the working position, wherein the belt is untensioned, a spring device for biasing the roller into the working position thereof, a double crank by which the roller is articulated with the frame, and a stop which, due to a change in position of the double crank from a position corresponding to the working position of the roller into a position corresponding to the moved-away position of the roller, is carried out to a given extent beyond a dead-center position of the double crank, preventing a change in position beyond the given extent.

In accordance with a concomitant feature of the invention, the machine for processing flat printing materials is a rotary printing machine.

In order to achieve the objective of the invention, there is thus provided a double crank, by the aid of which the roller is articulatedly secured to the frame, and also a stop which, upon the occurrence of a change in the position of the double crank from a position corresponding to the working position of the roller into a position corresponding to the moved-away position of the roller, which is carried out to a specific extent beyond a dead-center position of the double crank, prevents a change in position beyond the specific extent.

Through the use of the double crank, in order to displace the roller between the working position thereof and the position thereof moved away therefrom, it is merely necessary to pivot an arm of the double crank out of a position of the arm on this side of a dead-center position of the double crank into a position on the other side of this dead-center position and the reverse. By comparison with a screwing operation for tensioning or relieving the tension on the belt in the case of the aforementioned heretofore known belt drive, a pivoting action of this type is a measure which is comparatively simple and may be performed relatively quickly.

In a particularly advantageous construction, the double crank is formed by an eccentric shaft and a guide rod or lever articulatedly connected eccentrically thereto. This permits the particularly simple introduction of a pivoting movement into one arm of the double crank, namely, as a result of rotating the eccentric shaft, respectively, less than one complete revolution.

In a preferred exemplary embodiment, the stop is formed on the eccentric shaft and, in the position of the double crank corresponding to the moved-away position of the roller, is butted against the guide rod. Therefore, no features other than the double crank are needed in order to lock the latter, under the action of the spring device, in the position of the double crank corresponding to the moved-away position of the roller.

The invention is explained in greater detail with regard to the figures of the drawings, the details of which reproduce areas of use of the belt drive in connection with a machine which sets images on flat printing materials, and a preferred exemplary embodiment of the belt drive, and wherein identical parts are identified by like reference characters.

Other features which are considered as characteristic for the invention are set forth in the appended claims.

Although the invention is illustrated and described herein as embodied in a belt drive for a machine for processing flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
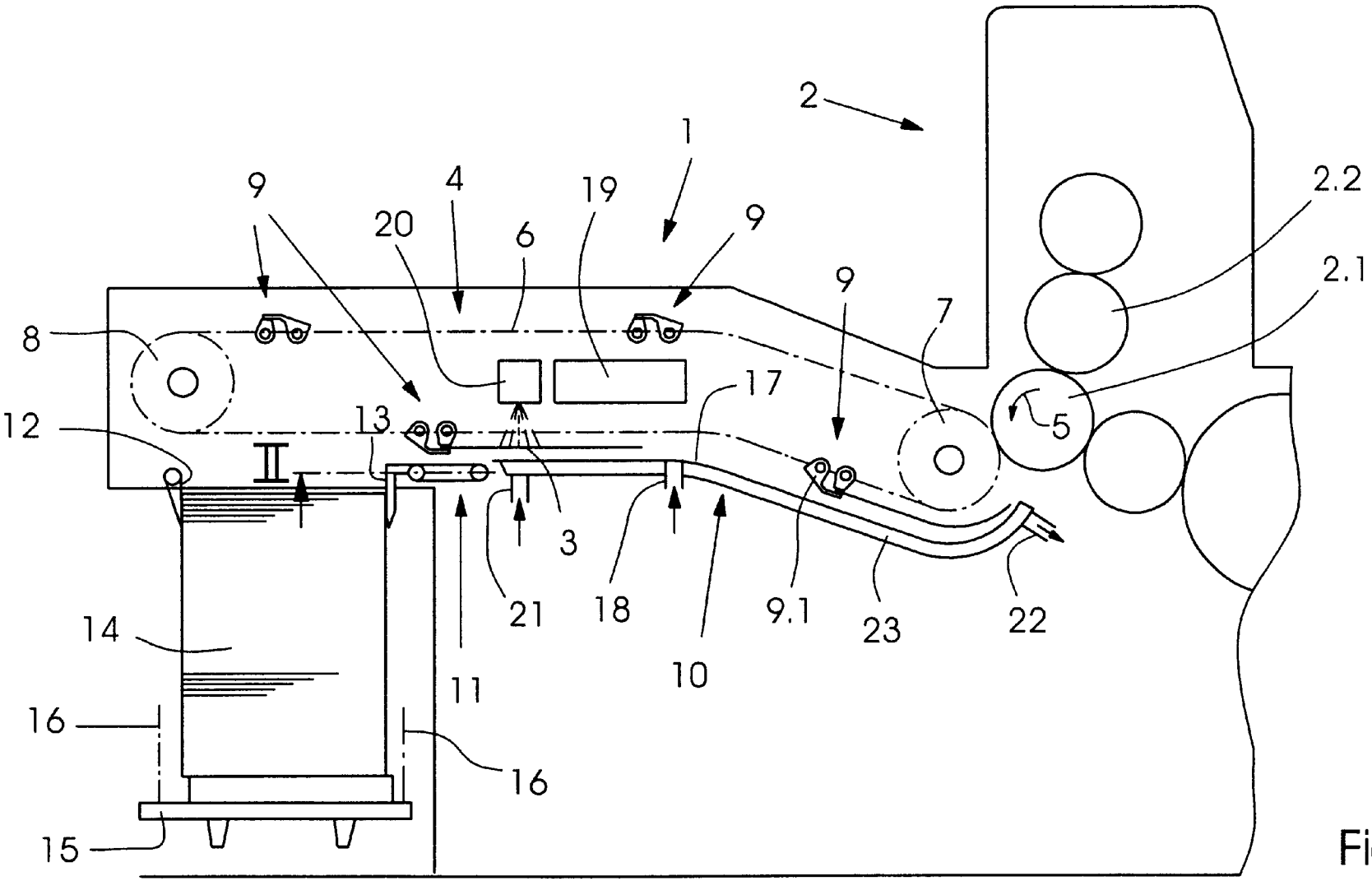
FIG. 1 is a fragmentary diagrammatic side elevational view of a sheet-processing rotary printing machine, constituting a delivery having a plurality of belt drives, installed herein adjacent to one another perpendicularly to the plane of the figure, and serving as a sheet brake.

Referring now to the drawings and, first, particularly to FIG. 1 thereof, there is shown therein an exemplary embodiment of a belt drive described hereinafter in greater detail, the belt drives being disposed many times, indeed, after one another perpendicularly to the plane of the figure, in order to form a sheet brake.

The delivery follows a last processing station of a printing machine. Such a processing station may be a printing unit or a post-treatment unit, such as a varnishing unit. In the example at hand, the last processing station is a printing unit 2 operating in accordance with the offset process and having an impression cylinder 2.1. The latter guides flat printing materials in the form of sheets 3, in the processing direction indicated by the arrow 5 indicating the direction of rotation thereof, through a printing nip between the impression cylinder 2.1 and a blanket cylinder 2.2 cooperating therewith, and then transfers the sheets 3 to a chain conveyor 4 while opening grippers provided on the impression cylinder 2.1 in order to grip a respective one of the sheets 3 at a gripper edge at the leading end of the sheet. The chain conveyor 4 has two endless conveyor chains 6, which, respectively, revolve along a respective side wall of the chain delivery 1 when in operation. A respective conveyor chain 6 looped about each of two synchronously driven drive sprockets 7, having axes of rotation aligned with one another and, in the exemplary embodiment of FIG. 1, are respectively led over a deflection or reversing sprocket 8 which is located downline of the drive sprockets 7, as viewed in the processing direction. Between the two conveyor chains 6, there extend gripper systems 9 borne by the latter and having grippers 9.1, which pass through gaps formed between the grippers arranged on the impression cylinder 2.1 and, in so doing, accept a respective sheet 3, gripping the aforementioned gripper edge at the leading end of the sheet 3, directly before the grippers arranged on the impression cylinder 2.1 open, transport the sheet over a sheet guide device 10 to a sheet brake 11, and open thereat in order to transfer the sheet 3 to the sheet brake 11. The latter imparts to the sheet a depositing speed which is reduced with respect to the processing speed and, after reaching the depositing speed, in turn, releases the sheet, so that a respective, now retarded sheet 3, finally encounters leading-edge stops 12 and, being aligned on the latter and on trailing-edge stops 13 located opposite thereto, forms together with preceding and/or following sheets 3, a sheet pile or stack 14, it being possible for the pile or stack 14 to be lowered by a lifting mechanism to an extent to which the pile or stack 14 grows. The lifting mechanism is represented in FIG. 1 only by a platform 15 which carries the pile or stack 14, and lifting chains 16 which carry the platform and are shown in phantom.

Along the paths thereof between the drive sprockets 7, on the one hand, and the deflection sprockets 8, on the other hand, the conveyor chains 6 are guided by non-illustrated chain guide rails, which therefore determine the chain paths of the chain strands. In the example at hand, the sheets 3 are transported by the lower chain strand in FIG. 1. That section of the chain path through which the lower chain strand passes is followed alongside by a sheet guide surface 17 which faces the section and is formed on the sheet guide device 10. During operation, a carrying-air cushion is preferably formed between the sheet guide surface 17 and the respective sheet 3 guided thereover. For this purpose, the sheet guide device 10 is equipped with blast or blown air nozzles which open into the sheet guide surface 17, only one of the nozzles 18 being reproduced in FIG. 1 as representative of all thereof symbolically.

In order to prevent mutual adhesion between the printed sheets 3 in the pile or stack 14, a drier 19 and a powdering device 20 are provided on the path of the sheets 3 from the drive sprockets 7 to the sheet brake 11.

In order to avoid excessive heating of the sheet guide surface 17 by the drier 19, a coolant circuit is integrated into the sheet guide device 10, and is indicated symbolically in FIG. 1 by an inlet nozzle 21 and an outlet nozzle 22 for a coolant trough 23 associated with the sheet guide surface 17.

Figure 2:
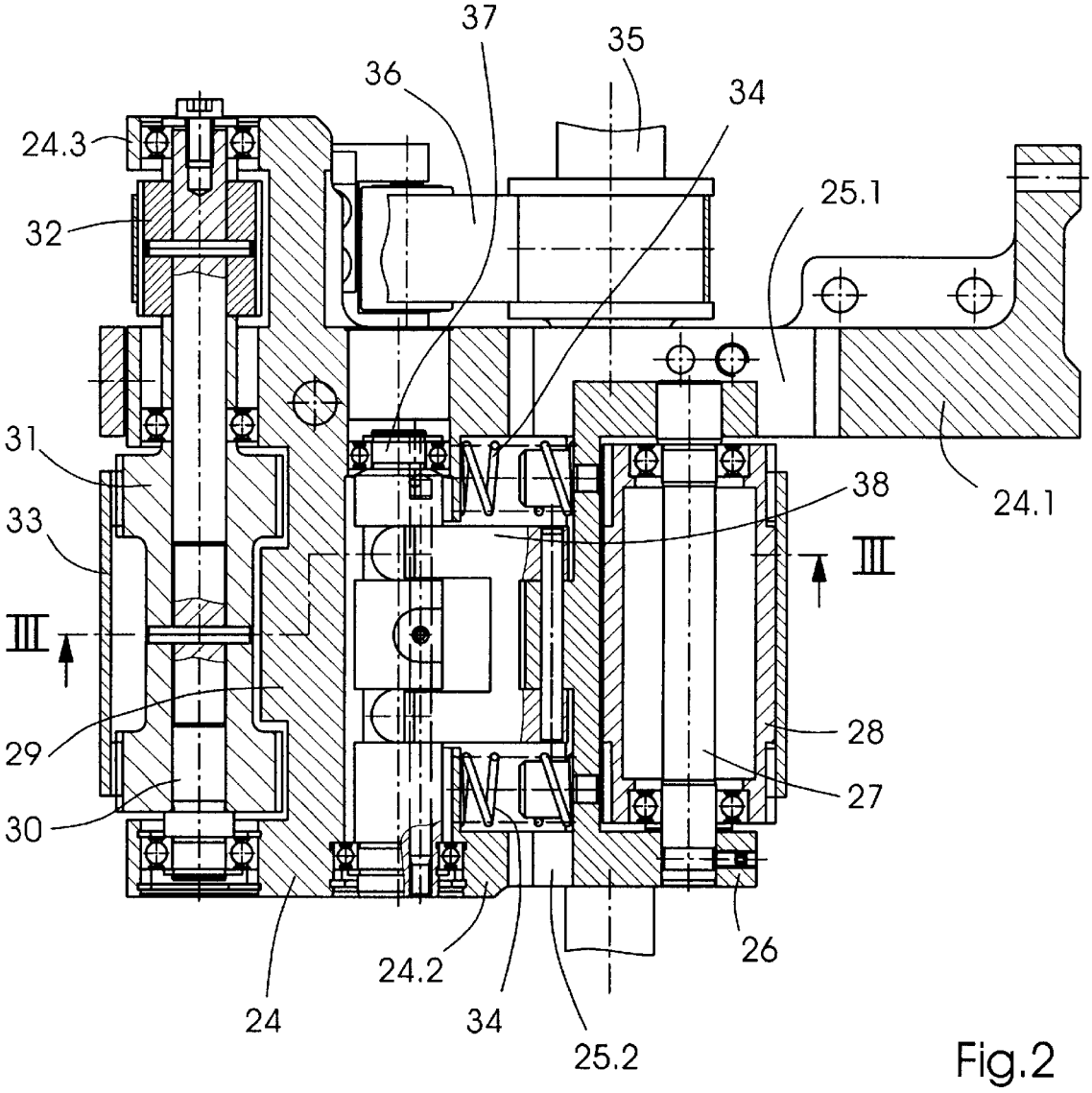
FIG. 2 is an enlarged sectional view of FIG. 1 taken along a line II in the direction of the associated arrow and representing a plane wherein there lie axes of rotation of rollers about which an endless belt is looped.

FIG. 2 reproduces a preferred exemplary embodiment of one of the belt drives forming the sheet brake 11, in a sectional view, more specifically in a section taken along the line II in FIG. 1, wherein a corresponding belt drive is illustrated only in stylized form.

According to FIG. 2, the belt drive includes a frame 24 having mutually parallel frame legs 24.1, 24.2 and 24.3, of which the frame leg 24.1 is formed, at a free end of the frame 24, for attachment to the delivery 1. Formed in the frame legs 24.1 and 24.2 are guide slots 25.1 and 25.2 which accommodate a slide 26 so that it is displaceable longitudinally along the frame legs 24.1 and 24.2. The slide 26 bears a shaft 27 which extends between the frame legs 24.1 and 24.2 and whereon a roller 28 is freely rotatably mounted. The frame legs 24.1, 24.2 and 24.3 are connected to one another by a web 29.

Also mounted in the frame legs 24.1, 24.2 and 24.3 is a shaft 30 extending parallel to the shaft 27. A further roller 31 and a drive wheel 32 are fixed to the shaft 30 so that they rotate therewith. Slung around the rollers 28 and 31 is an endless belt 33 which, in the embodiment of FIG. 2, is formed as a toothed belt and, when operating, engages or meshes with corresponding tooth systems formed on the rollers 28 and 31.

Supported on the frame 24, on the one hand, and on the slide 26, on the other hand, is a spring device formed by compression springs 34, so that they bias the roller 28 into a working position thereof, wherein the belt 33 is tensioned. In this working position of the roller 28, the belt drive is ready to operate and is drivable by a drive shaft 35, which is operatively connected to the drive wheel 32 via a belt drive 36.

Between the frame legs 24.1 and 24.2, there extends an eccentric shaft 37 which is mounted in the legs and extends parallel to the shaft 27. This eccentric shaft 37 is formed of a circularly cylindrical basic body 37.1 (note FIG. 5), which is penetrated in the longitudinal direction thereof by an eccentrically disposed pin 37.2, that can be seen in cross section in FIGS. 3*a* and 3*b*, and has deep flats 37.1' so that they expose the pin 37.2 over the respective extent thereof in the aforementioned longitudinal direction. A drive rod or lever 38 has an articulated connection on one side thereof to a respective section of the pin 37.2 which is exposed by the flat 37.1' and, on the other side, an articulated connection to the slide 26. The drive rod 38 and the eccentric shaft 37 formed of the basic body 37.1 and the pin 37.2 thus form a first and a second arm of a double crank 37, 38, by which the slide 26 and, therefore, the roller 28 are articulated with the frame 24. With this type of articulation of the roller 28 to the frame 24, the roller 28 is adjustable to different axial spacings with respect to the roller 31 whenever a change in position of the double crank 37, 38 is effected by rotating the eccentric shaft 37.

In order to introduce a rotational movement into the eccentric shaft 37, an internal hexagon 37.1" is provided at one end of the eccentric shaft 37, so that the eccentric shaft 37 is rotatable by a hexagon key inserted into the internal hexagon 37.1".

Figure 3A:
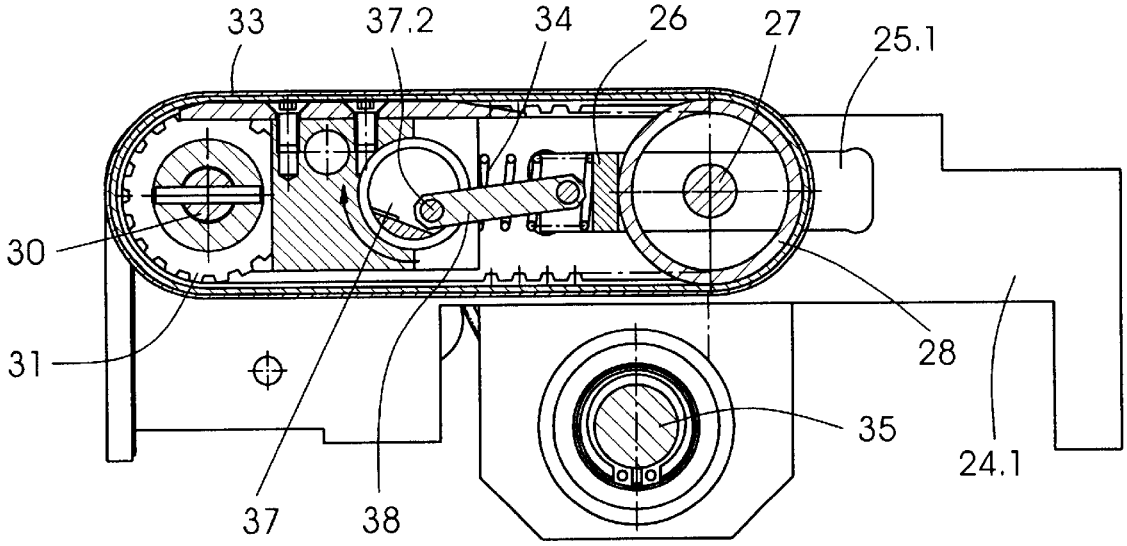
FIG. 3*a* is a sectional view of FIG. 2 taken along a line III—III in the direction of the arrows, in an operating phase of the belt drive wherein the belt is in a tensioned state.

In FIGS. 2 and 3*a*, the belt drive is illustrated in the tensioned state of the belt 33. The axial spacing which is derived, in this case, from the length and the properties of the material of the belt 33 and the compressive force exerted on the slide 26 by the compression springs 34. The double crank 37, 38 is formed so that when the belt 33 is tensioned, the arms thereof are located in front of a dead-center position defined by an extended or stretched position of the arms. In order to achieve a position that is moved away from the working position of the roller 28 and wherein the belt 33 is untensioned, the arm of the double crank 37, 38 formed by the eccentric shaft 37 is initially rotated, counter to the action of the compression springs 34, so that the arms of the double crank 37, 38 fold together until they reach a second dead-center position. After this dead-center position has been passed, the compression springs 34 then effect a further rotation of the eccentric shaft 37 by an amount which is defined by a stop which will be explained further hereinbelow so that the axial spacing of the roller 28 from the roller 31 is increased, during this further rotation of the eccentric shaft 37, by an amount smaller than that by which it was decreased until it reached the dead-center position of the double crank 37, 38 which has now been passed. When the position of the double crank 37, 38 which is defined by the stop is reached, the roller 28 is therefore in the position thereof wherein it is moved away from the working position thereof and wherein the belt 33 is untensioned. The position assumed by the double crank 37, 38, in this regard, is illustrated in FIG. 3*b*.

Under the action of the compression springs 34 operating against the stop, the double crank 37, 38 also maintains the position corresponding to the position of the roller 28, wherein it is moved away from the working position.

Figure 3B:
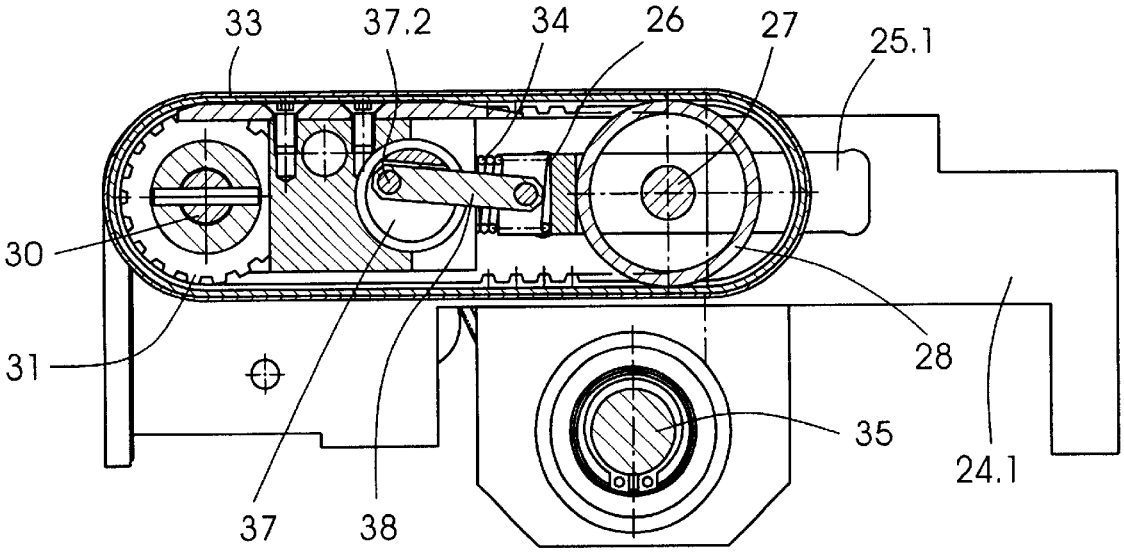
FIG. 3*b* is a view like that of FIG. 2, showing the belt in a different operating phase thereof wherein it is in an untensioned state.
Figure 4:
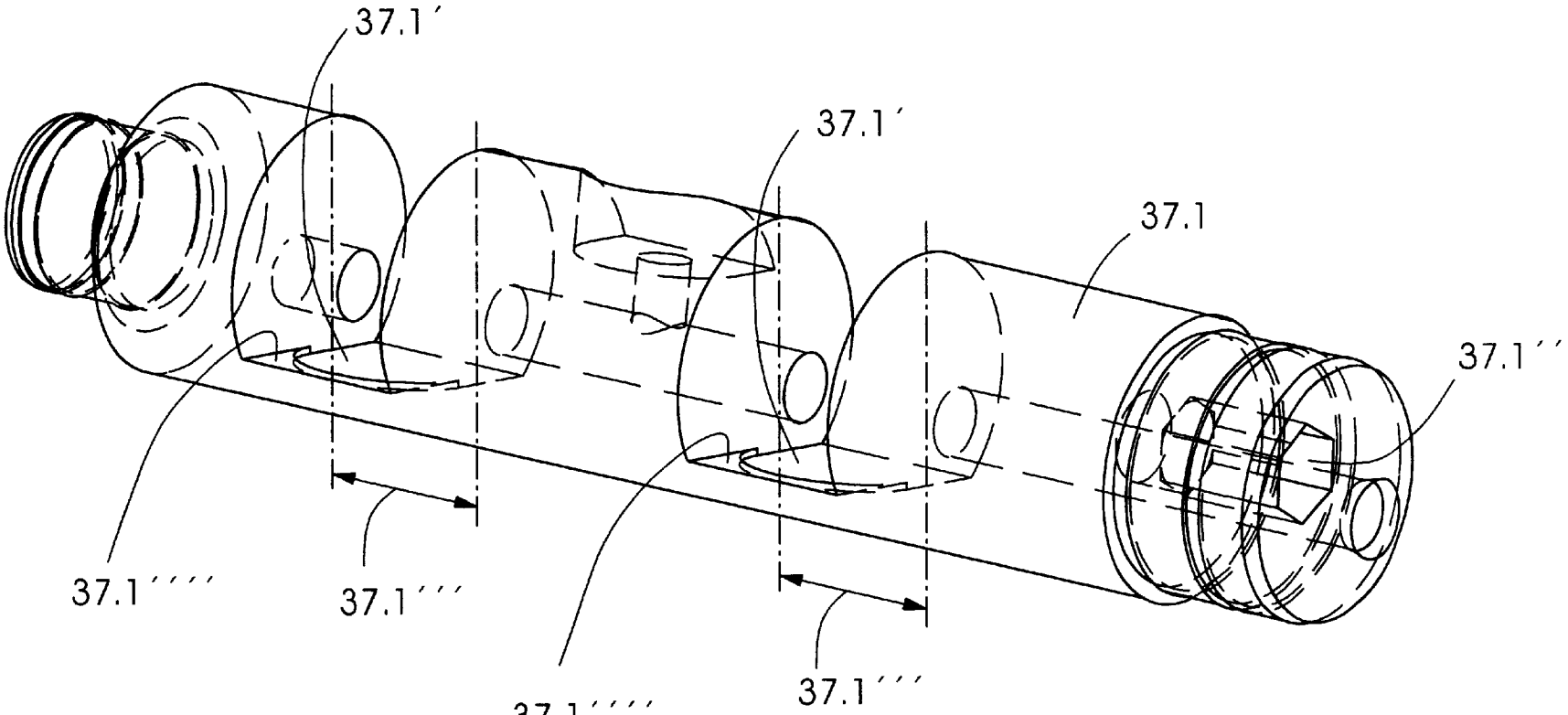
FIG. 4 is an enlarged fragmentary perspective view of FIG. 2 showing a double crank in a preferred embodiment as an eccentric shaft, by the aid of which one of the rollers is linked to a frame.

In a preferred construction, the stop mentioned hereinbefore is formed on the eccentric shaft 37, more specifically in the form of respective flattened shaft sections 37.1'" formed by the flats 37.1', whereon, respectively, a stop face 37.1'" is formed which, according to FIG. 3*b*, in the position of the double crank 37, 38 corresponding to the untensioned position of the belt 33, is stopped against the guide rod 38, and therefore prevents a change in the position of the double crank 37, 38 going beyond the same defined extent, after passing over the dead-center position through which it passed during the change in position of the double crank 37, 38.

When the belt drive which has been described hereinbefore is used as a constituent part of the sheet brake 11 or of a sheet conveying table, the belt 33 is penetrated by suction openings and, when operating, sweeps over a wall having at least one opening and belonging to a suction chamber that is connected to a vacuum generator. In a particular construction, a respective belt drive of the sheet brake 11 accepts a respective sheet 3 at a circumferential speed of the belt 33 corresponding to the processing speed of the sheets 3, and then brakes the respective sheet 3 sucked thereagainst while retarding the belt 33 to a depositing speed.

Figure 5:
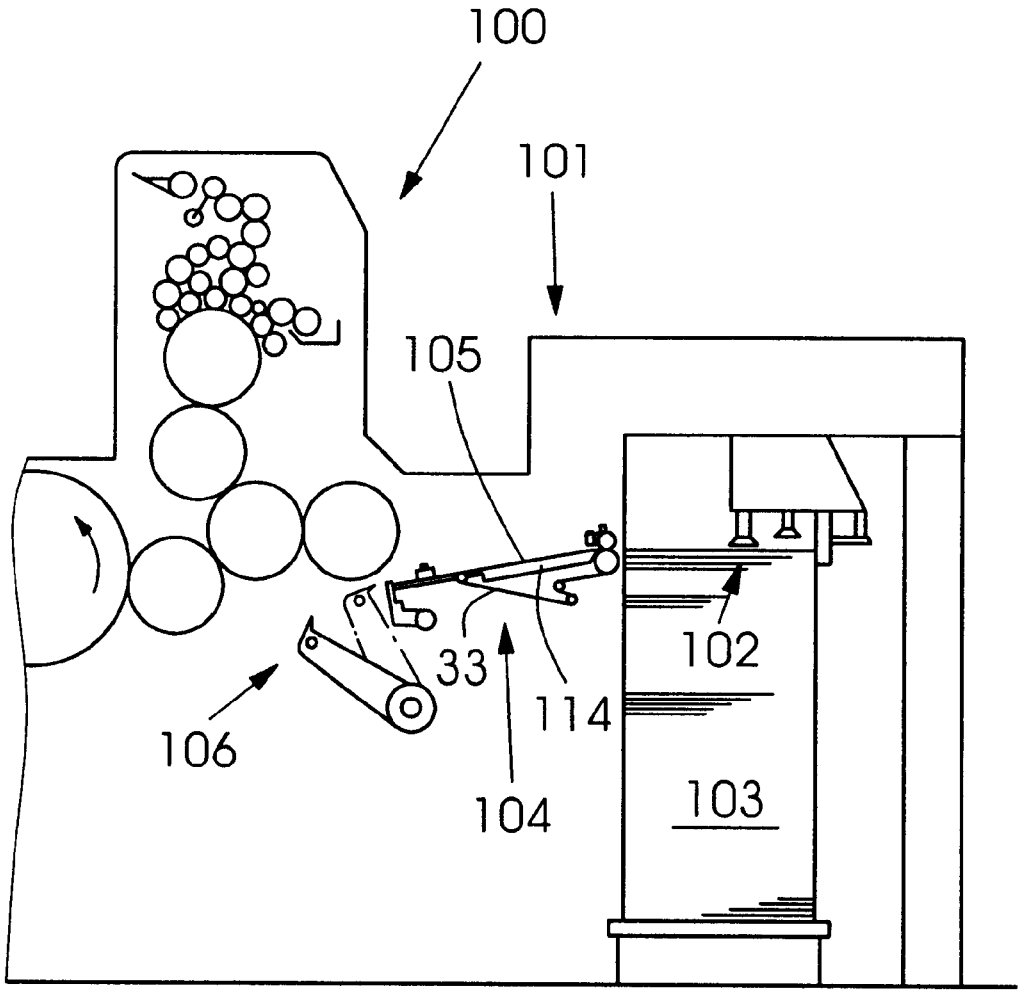
FIG. 5 is a fragmentary diagrammatic side elevational view of a sheet-processing rotary printing machine, having a plurality of belt drives disposed adjacent to one another perpendicularly to the plane of the figure, and forming a sheet conveyor of a sheet feeding table.

FIG. 5 illustrates a use of the proposed belt drive in a sheet feeder cooperating with a printing unit of a sheet-fed printing machine. In this case, the sheet-fed printing machine provided by way of an example is a rotary offset printing machine, of which a first processing station 100, in this embodiment, formed as a printing unit, and a sheet transport device 101 formed as a feeder for feeding sheets to the printing unit, are reproduced diagrammatically. When operating, the feeder takes the sheets individually by a separating or singling device 102 from a pile or stack 103 formed of the sheets and deposits the sheets on a transport strand 105 of a belt 33' belonging to an overall identified belt drive 104 here. The separated sheets 3 are transported thereby to a transfer device 106. In the exemplified embodiment of FIG. 5, the transfer device 106 includes a pregripper oscillating between a feeding table and a feeding drum in accordance with the sheet processing cycle, gripping the sheets aligned on the feeder table at a gripper edge and transferring them to a gripper system provided on the feeder drum.

We claim:

1. A belt drive for a machine for processing flat printing materials, comprising an endless belt revolving during operation, a roller about which said belt is partially looped, a frame with respect to which said roller is adjustable between a working position, wherein said roller keeps the belt tensioned, and a position moved away from said working position, wherein the belt is untensioned, a spring device for biasing said roller into said working position thereof, a double crank by which said roller is articulated with said frame, and a stop which, due to a change in position of said double crank from a position corresponding to said working position of said roller into a position corresponding to said moved-away position of said roller, is carried out to a given extent beyond a dead-center position of said double crank, prevents a change in position beyond said given extent.

2. The belt drive according to claim 1, wherein said double crank is formed by an eccentric shaft and a guide rod articulated eccentrically therewith.

3. The belt drive according to claim 1, wherein said stop is formed on said eccentric shaft and, in said position of said double crank corresponding to said moved-away position of said roller, butts against said guide rod.

4. A machine for processing flat printing materials, comprising a conveying station in the form of a feeder for supplying sheets to a first processing station, and a conveying station in the form of a delivery for feeding sheets accepted from a last processing station to a sheet pile station, at least one of said conveying stations being equipped with a belt drive, including an endless belt revolving during operation, a roller about which the belt is partially looped, a frame with respect to which the roller is adjustable between a working position, wherein the roller keeps the belt tensioned, and a position moved away from the working position, wherein the belt is untensioned, a spring device for biasing the roller into the working position thereof, a double crank by which the roller is articulated with the frame, and a stop which, due to a change in position of the double crank from a position corresponding to the working position of the roller into a position corresponding to the moved-away position of the roller, is carried out to a given extent beyond a dead-center position of said double crank, preventing a change in position beyond said given extent.

5. The machine according to claim 4, being a rotary printing machine.

* * * * *

UNITED STATES PATENT AND TRADEMARK OFFICE

CERTIFICATE OF CORRECTION

PATENT NO. : 6,354,203 B2
DATED : March 12, 2002
INVENTOR(S) : Dieter Bäcker et al.

It is certified that error appears in the above-identified patent and that said Letters Patent is hereby corrected as shown below:

Title page,
Item [75], should read as follows: -- Dieter Bäcker, Sandhausen; Ralf Weiser, Ladenburg; Roland Hirth, Römerberg, all of (DE); Richard Mack, Kennesaw, GA (US) --

Signed and Sealed this

Twentieth Day of August, 2002

*Attest:*

*Attesting Officer*

JAMES E. ROGAN
*Director of the United States Patent and Trademark Office*